US007952421B2

(12) United States Patent
Tripodi et al.

(10) Patent No.: US 7,952,421 B2
(45) Date of Patent: May 31, 2011

(54) ALL NPN-TRANSISTOR PTAT CURRENT SOURCE

(75) Inventors: Lorenzo Tripodi, Eindhoven (NL); Mihai A.T. Sanduleanu, Yorktown Heights, NY (US); Pieter G. Blanken, Nuenen (NL)

(73) Assignee: ST-Ericsson SA, Geneva (CH)

( * ) Notice: Subject to any disclaimer, the term of this patent is extended or adjusted under 35 U.S.C. 154(b) by 382 days.

(21) Appl. No.: 11/719,209

(22) PCT Filed: Nov. 8, 2005

(86) PCT No.: PCT/IB2005/053670

§ 371 (c)(1),
(2), (4) Date: May 11, 2009

(87) PCT Pub. No.: WO2006/051486

PCT Pub. Date: May 18, 2006

(65) Prior Publication Data

US 2009/0295465 A1 Dec. 3, 2009

(30) Foreign Application Priority Data

Nov. 11, 2004 (EP) ..... 04105701

(51) Int. Cl.
*H01L 35/00* (2006.01)

(52) U.S. Cl. ..... 327/513; 327/538; 327/512

(58) Field of Classification Search ..... 327/512, 327/513, 538

See application file for complete search history.

(56) References Cited

U.S. PATENT DOCUMENTS 3,893,018 A * 7/1975 Marley ..... 323/313
4,277,739 A * 7/1981 Priel ..... 323/313
4,525,663 A * 6/1985 Henry ..... 323/280
4,603,291 A * 7/1986 Nelson ..... 323/315
4,636,710 A * 1/1987 Stanojevic ..... 323/280
4,672,304 A * 6/1987 Degrauwe et al. ..... 323/314
2001/0043110 A1 * 11/2001 Iliasevitch ..... 327/375
2003/0080807 A1 * 5/2003 Dasgupta et al. ..... 327/543
2003/0107360 A1 * 6/2003 Gheorghe et al. ..... 323/313
2003/0201791 A1 10/2003 Andrys et al.

OTHER PUBLICATIONS

"New Class of High-Performance PTAT Current Sources", H.C. Nauta and E.H. Nordholt, Electron. Lett, Apr. 1985.
"Bidriectional Current-Controlled PTAT Current Source", A Fabre, IEEE Trans. on Cir. and Sys.-I, Dec. 1994.
International Search Report dated Jul. 26, 2006 in connection with PCT Patent Application No. PCT/IB2005/053670.
Written Opinion of the International Searching Authority dated May 11, 2007 in connection with PCT Patent Application No. PCT/IB2005/053670.

* cited by examiner

*Primary Examiner* — Lincoln Donovan
*Assistant Examiner* — Ryan C Jager

(57) ABSTRACT

The present invention relates to an improved PTAT current source and a respective method for generating a PTAT current. Opportune collector currents are generated and forced in two transistors exploiting the logarithmic relation between the base-emitter voltage and the collector current of a transistor. A resistor senses a voltage difference between the base-emitter voltages of the two transistors, which can have either the same or different areas. A fraction of the current flowing through the resistor is forced into a transistor collector and mirrored by an output transistor for providing an output current. By this principle an all npn-transistor PTAT current source can be provided that does not need pup transistors as in conventional PTAT current sources. The invention is generally applicable to a variety of different types of integrated circuits needing a PTAT current reference, especially in modern advanced technologies as InP and GaAs where p-type devices are not available. For example, the PTAT current source circuit of the invention can be used in radio frequency power amplifiers, in radio frequency tag circuits, in a satellite microwave front-end.

17 Claims, 7 Drawing Sheets

ALL NPN-TRANSISTOR PTAT CURRENT SOURCE

CROSS-REFERENCE TO RELATED APPLICATION(S)

The present application claims priority under 35 U.S.C. §365 to International Patent Application No. PCT/IB2005/053670 filed Nov. 8, 2005, entitled "ALL NPN-TRANSISTOR PTAT CURRENT SOURCE". International Patent Application No. PCT/IB2005/053670 claims priority under 35 U.S.C. §365 and/or 35 U.S.C. §119(a) to European Patent Application No. 04105701.9 filed Nov. 11, 2004 and which are incorporated herein by reference into the present disclosure as if fully set forth herein.

The present invention relates to a circuit according to claim 1.

Current references are well known circuits, extensively used in a wide range of applications, going from A/D and D/A converters to voltage regulators, memories and bias circuits. One of the most important kinds of current references is the so-called Proportional To Absolute Temperature (PTAT) current source that generates a current varying in a linear way versus temperature. A simplified conventional PTAT current source scheme is shown in FIG. 8 which, for instance, can be found in H. C. Nauta and E. H. Nordholt, "New class of high-performance PTAT current sources", Electron. Lett, vol. 21, pp. 384-386, April 1985.

The basic idea behind this PTAT reference circuit is a core of two npn-transistors T1 and T2 and a resistor R. Equal currents are supplied to transistors T1 and T2 by current sources which are generated by a current mirror constituted by two pnp-transistors T4 and T3. Thus, equal collector currents $I_{c1}$, $I_{c2}$ are forced into both transistors T1 and T2. Because the junction areas of transistors T1 and T2 differ by a factor n, unequal current densities exist in the transistors T1 and T2 which results in a difference between the base-emitter voltages $V_{be1}$ and $V_{be2}$ of transistor T1 and transistor T2. This difference is used to generate a PTAT current in the resistor R. Assuming that all the transistors T1, T2 are ideal and forward biased, the following relation holds:

$$I_R = \frac{V_{be2} - V_{be1}}{R} = \frac{\eta V_T}{R}\ln(n) \tag{1}$$

In equation (1), $$V_T = \frac{kT}{q}$$

is the thermal voltage defined by the product of the Boltzmann's constant k and absolute temperature T divided by the electron charge q, η is the forward emission coefficient. Because the collector currents $I_{c1}$ and $I_{c2}$, respectively, in transistor T1 and transistor T2 are the same, the output PTAT current can be written as:

$$I_{PTAT} = 2I_R = 2\frac{\eta V_T}{R}\ln(n) \tag{2}$$

As can be seen from equation (2), the output current $I_{PTAT}$ is proportional to the absolute temperature as well as independent on the supply voltage.

However, the circuit in FIG. 8 has another possible stable state, where the currents are zero. Therefore, in practical implementations of the conventional PTAT current sources more elaborate modifications of the one in FIG. 8 are needed. For instance, an additional start-up circuitry avoids the state with zero current. A. Fabre, "Bidirectional current-controlled PTAT current source", IEEE Trans. On Cir. And Sys.-I, vol 41, No. 12, December 1994 discloses a more sophisticated implementation without start-up circuitry, which allows bidirectional PTAT currents.

However, a drawback of known PTAT current sources is that both n-type and p-type transistors are needed. This can be a major problem if these circuits are to be implemented in processes as Indium Phosphide (InP), Gallium Arsenide (GaAs), e.g. preferably used for RF and microwave applications, Silicon on Insulator (SOI), e.g. used in the emerging market of RF tags, or any other technology where either n-type or p-type semiconductor devices are available or where the complementary type of semiconductor devices has poor performance. Further, the afore-described PTAT current source principle needs two bipolar transistors having a difference in areas for generation of the difference in the base-emitter voltages.

It is an objective of the present invention to provide a PTAT current source which can also be implemented with equal transistors for generating the temperature dependent voltage difference. It is a further object of the invention to propose a PTAT circuit topology which does not need start-up circuitry. It is yet another objective of the present invention to use only n-type semiconductor devices.

The invention is defined by the independent claim. The dependent claims define advantageous embodiments.

It is provided a circuit for generating a current being proportional to absolute temperature comprising a first current path including a first resistive element and first transistor means coupled to a first node and a second current path in parallel with the first current path including a second resistive element and a second transistor means coupled to a second node. It is further provided a PTAT current path in parallel with the first and second current paths including a first current source configured to be controlled by a signal from said first node, a second current source configured to be controlled by a signal from said second node, and a current sensing element coupled between said first current source and said second current source at a third node and a fourth node, respectively. A control terminal of the first transistor means is coupled to the fourth node and a control terminal of the second transistor means is coupled to the third node.

According to the invention, opportune collector currents in the first and second transistor means exploiting the logarithmic relation between the respective base-emitter voltages and the respective collector currents, are generated and forced, for avoiding the needed complementary transistors as in conventional PTAT current sources. Further, the PTAT current sourcing circuit may also be implemented with the first and second transistor means being equal.

According to a first embodiment, the circuit further comprises a third current path including a third current source configured to be controlled by said signal of said second node and to emboss a reference current into current mirror means. Advantageously, said second current source can be provided by a mirror current source of said current mirror means, which is indirectly controlled via said third current source by said signal of said second node.

According to a second embodiment, the circuit further comprises a fifth current path including a third resistive element and third transistor means. A control terminal of said third transistor means is coupled to said third node.

According to a third embodiment, said circuit further comprises a sixth current path including a sixth current source and a seventh current source coupled at a fifth node. Said sixth current source is configured to be controlled by a signal of said second node and said seventh current source is configured to be controlled by a signal of said third node, wherein said second current source is configured to be controlled by a signal from said fifth node.

For providing a proportional to absolute temperature output current, said circuits according to the first, second, and third embodiments may further comprise a fourth current path including a fourth current source configured such that a current of said fourth current source is proportional to a current of said second current source. In a further development, said fourth current path may further comprise a fifth current source configured to be controlled by said signal from said first node.

As a major advantage of the circuit according to the invention, said respective current sources can be implemented by respective transistor means. Generally, said transistor means can be any kind of applicable transistor elements. Advantageously, said transistor means of said circuit may either be all n-type transistor elements, preferably npn-transistors are used, or be all p-type transistor elements.

The invention will be more completely understood in consideration of the following detailed description of various embodiments of the invention in connection with the accompanying drawings, in which.

Figure 1:
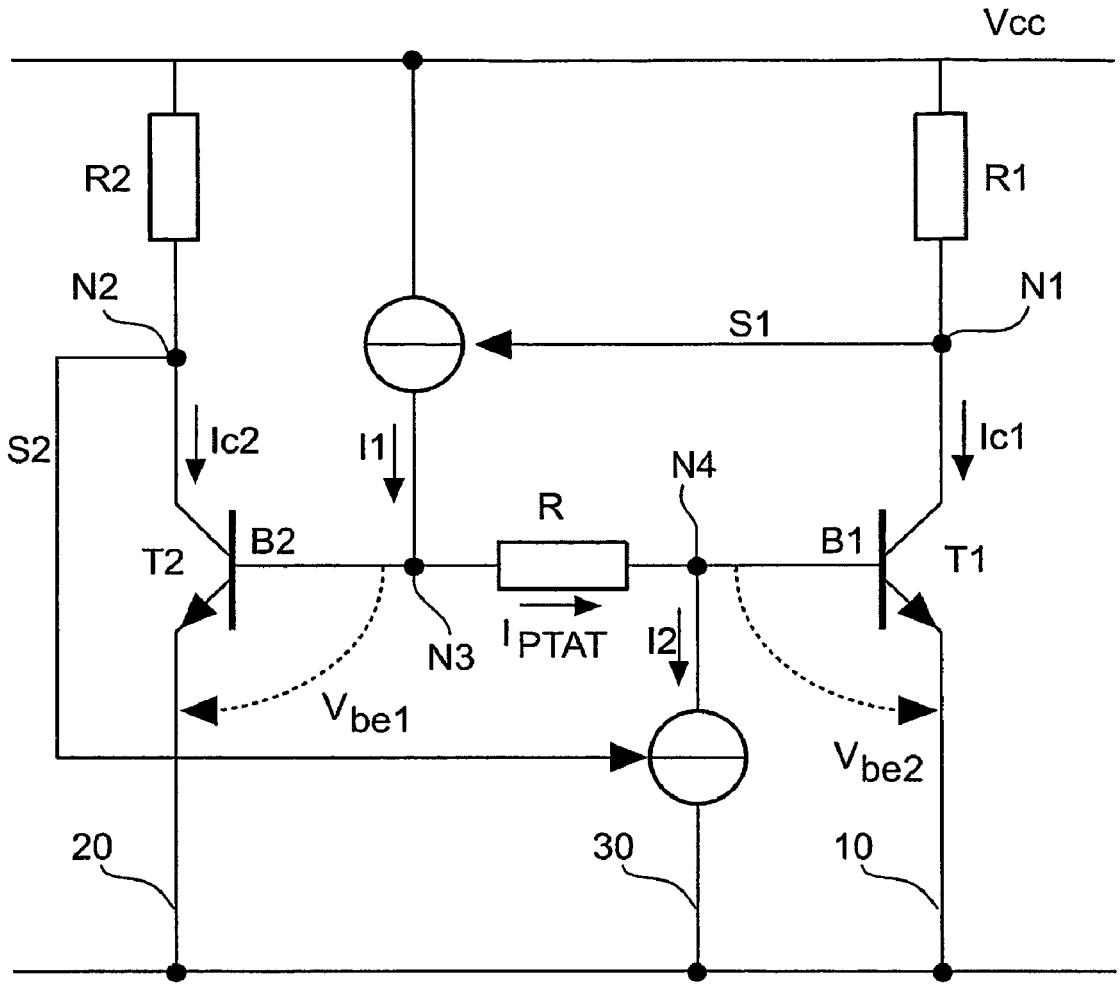
FIG. 1 shows a schematic circuit diagram for illustration of the general principle of the invention.

FIG. 1 depicts a simplified schematic circuit diagram for illustrating the general principle of the invention. The circuit for generating the proportional to absolute temperature current comprises a first current path 10 and a second current path 20 in parallel with the first current path 10. There is further a proportional to absolute temperature (PTAT) current path 30 in parallel with the first current path 10 and second current path 20. The first current path 10 includes a first resistive element R1 and first transistor means T1 coupled at a first node N1. The second current path 20 includes a second resistive element R2 and a second transistor means T2 coupled at a second node N2. The PTAT current path includes a first current source I1, a second current source I2, and a resistor R as a current sensing element inter-coupled between the first current source I1 and the second current source I2 at a third node N3 and a fourth node N4, respectively. The first current source I1 is configured to be controlled by a signal S1 from said first node N1 and the second current source I2 is configured to be controlled by a signal S2 from said second node N2. A control terminal B1 of said first transistor means T1 is coupled to said fourth node N4 and a control terminal B2 of said second transistor means T2 is coupled to said third node N3.

When the supply voltage $V_{cc}$ is supplied to the circuit the resistive elements R1 and R2 pull up the potentials of the first node N1 and second node N2 to $V_{cc}$ causing the first and second current source to supply current into the PTAT current path. This results in conduction of the first and second transistor means and currents are beginning to flow in the respective first and second current paths 10, 20, which correspond to the respective collector currents $I_{c1}$ and $I_{c2}$, which are exponentially related to the respective base-emitter voltages of the first and second transistor means T1 and T2. Due to the configuration of the circuit the difference between the base-emitter voltages $V_{be1}$ and $V_{be2}$ equals the voltage drop across resistor R of which the voltage drop and the respective current obey a linear relation. Hence, the circuit according to the invention is self-biasing into a stable state, i.e. operating point. Again it is clear that the current through the resistor R is proportional to absolute temperature T, described by relation (1).

Figure 8:
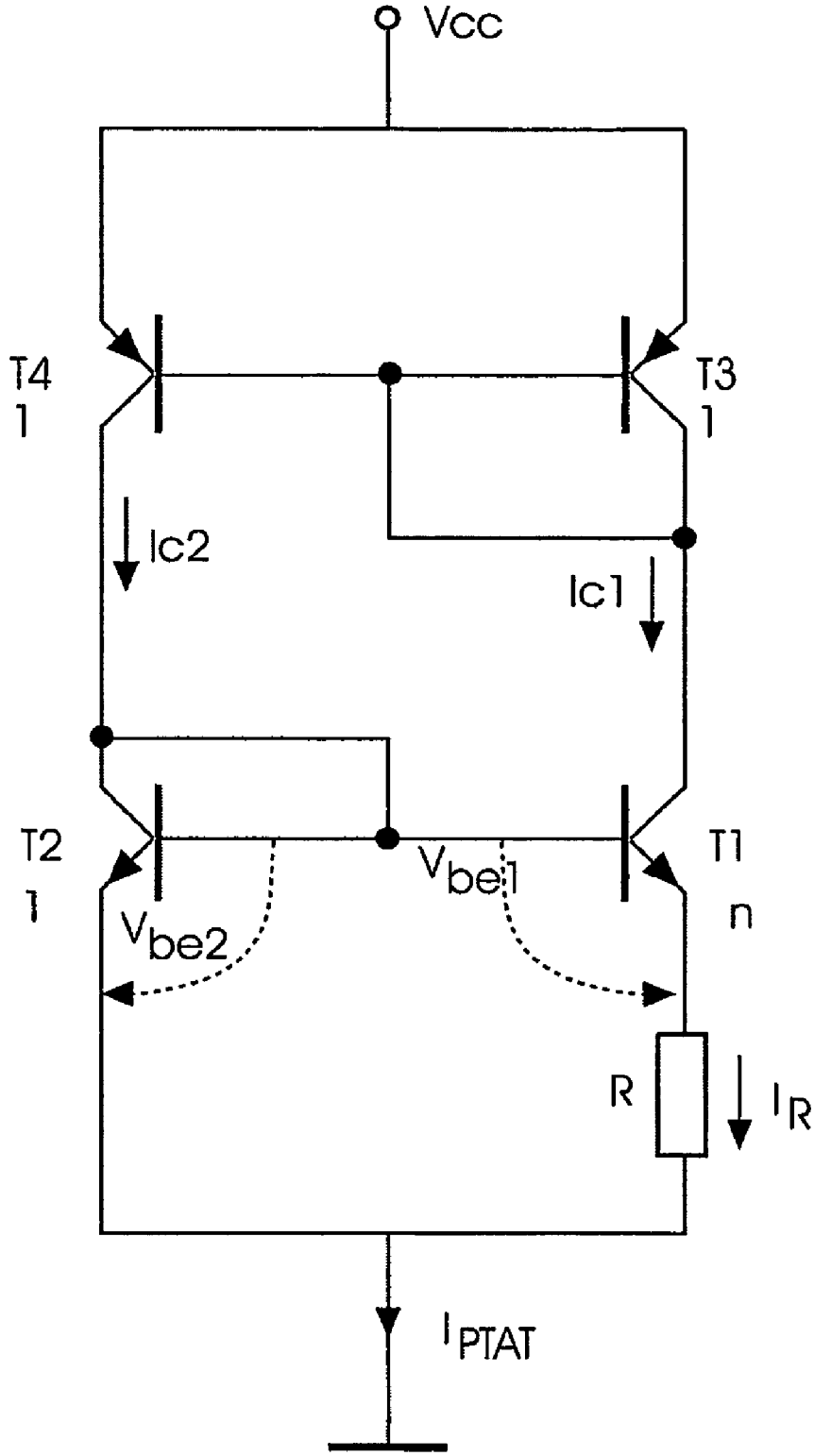
Fig.8 PRIOR ART
FIG. 8 shows a simplified conventional PTAT current source circuit of the prior art.

That is, the PTAT current source of the invention does not need the p-type transistors T1 and T2 as in the conventional PTAT current source of FIG. 8. Advantageously, there are only n-type transistor elements needed and due to its self-biasing behaviour the circuit does not need a start-up circuit. Therefore, the PTAT current source principle according to the invention is particularly suitable for circuits in new processes as Indium Phosphide, Gallium Arsenide, and any other technology where p-type semiconductor devices are not available.

Figure 2:
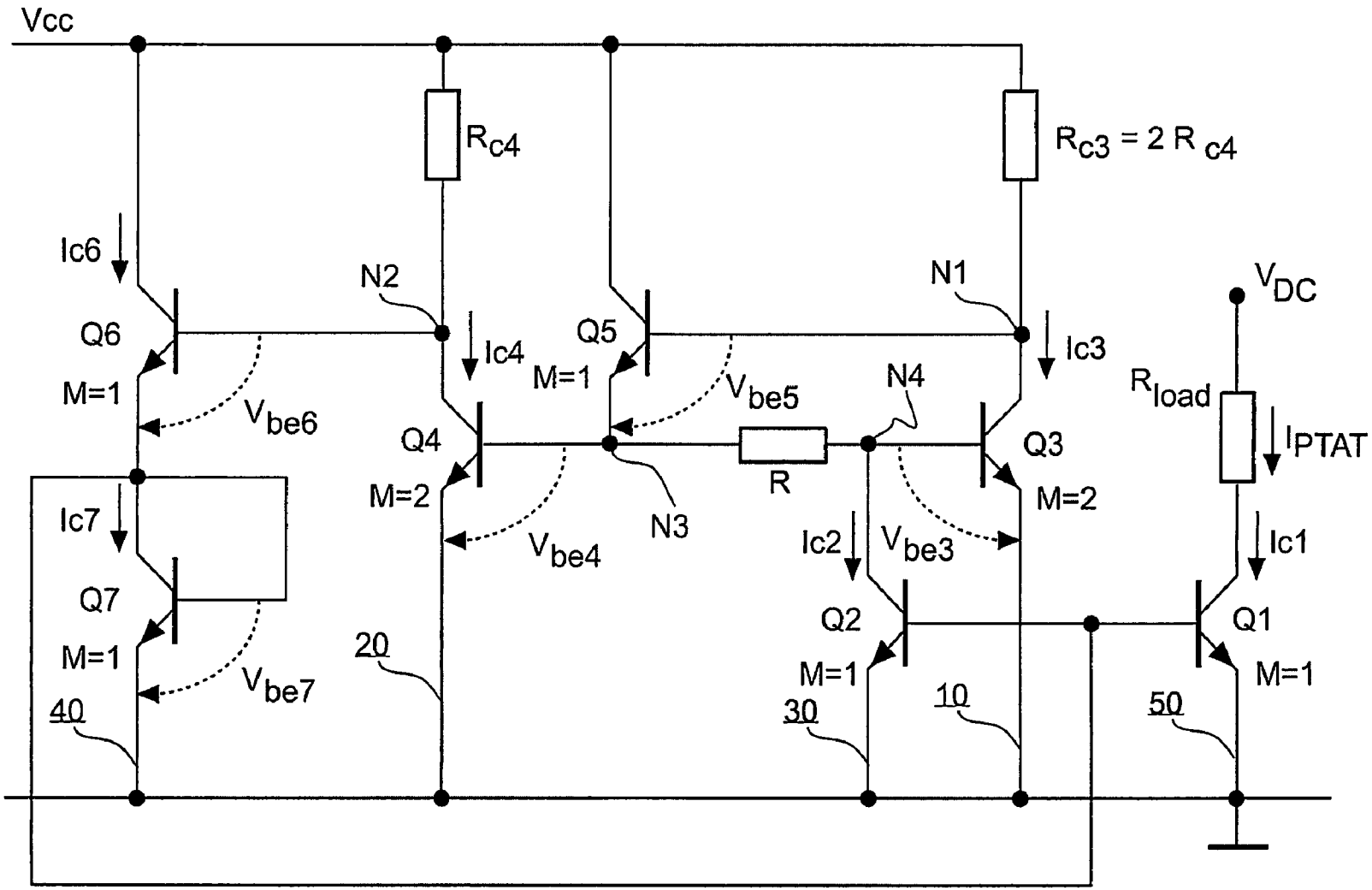
FIG. 2 shows a first embodiment of the PTAT current source of the invention.

FIG. 2 depicts a first embodiment of the PTAT current source of the present invention. In the circuit there is the first current path 10 and the second current path 20 in parallel with the first current path 10 both connected between a supply voltage $V_{cc}$ and a reference potential of the circuit, e.g. ground. There is further the proportional to absolute temperature (PTAT) current path 30, also coupled between the supply voltage $V_{cc}$ and the reference potential of the circuit. The first current path 10 includes a resistor $R_{c3}$ as the first resistive element and a transistor Q3 as the first transistor means T1 coupled at a node N1 as the first node. The second current path 20 includes a resistor $R_{c4}$ as the second resistive element and a transistor Q4 as the second transistor means coupled at node N2 as the second node. The PTAT current path includes a transistor Q5 as the first current source I1, a transistor Q2 as the second current source I2, and a resistor R as the current sensing element inter-coupled between transistor Q5 and transistor Q2 at the third node N3 and the fourth node N4, respectively. The transistor Q5 is configured to be controlled by a signal from the first node N1 and transistor Q2 is configured to be controlled by a signal from the second node N2. A control terminal of transistor Q3, i.e. the base of Q3, is coupled to the fourth node N4 and a control terminal of transistor Q4, i.e. the base of Q4, is coupled to the third node N3.

There is further a third current path 40, also coupled between the supply voltage Vcc and the reference potential of the circuit. The third current path 40 includes a transistor Q6 as the third current source and a transistor Q7 in diode configuration as input transistor of a current mirror 100 constituted of transistors Q7 and Q2. A control terminal of transistor Q6, i.e. the base of Q6, is coupled to the second node N2. A control terminal of transistor Q7, i.e. the base of Q7, is coupled to the collector of transistor Q7 and the emitter of transistor Q6.

There is yet a fourth current path 50, connected between a supply voltage $V_{dc}$ and the reference potential of the circuit. The fourth current path 50 includes a transistor Q1 as the fourth current source. The transistor Q1 is configured such that its base is coupled to the base of transistor Q7 and the base of transistor Q2, respectively. Hence, transistor Q1 mirrors the current of transistor Q7 and Q2, respectively. Since transistors Q7, Q2, Q1 have equal areas depicted by M=1 the respective collector currents $I_{c7}$, $I_{c2}$, and $I_{c1}$ are substantially the same.

In order to explain how the circuit in FIG. 2 works, it is to be noted that the currents of the circuit are configured such that $I_{c4}=2I_{c3}$. From simple considerations and using Kirchhoff's current law it can be derived that:

$$I_{c1} = I_{c2} = I_{c7}$$

$$I_{c6} = \frac{3I_{c7}}{\beta} + I_{c7}$$

$$I_{c5} = I_{c7} + \frac{I_{c4}}{\beta} + \frac{I_{c3}}{\beta} = I_{c7} + \frac{3I_{c3}}{\beta}$$

where it can be assumed, for simplicity, that $$I_{cx} \approx I_{ex} \left(\text{i.e. } \frac{\beta+1}{\beta} \cong 1\right).$$

$I_{cx}$ and $I_{ex}$ are the collector and emitter currents of the transistor Qx.

Being $V_{be}(I_c)=\eta V_T \ln(I_c/I_s)$ the general relation between the transistor's base-emitter voltage and the collector current in forward bias condition and for a given saturation current $I_s$, it can be written:

$$V_{be6} + V_{be7} = \eta V_T \ln\left[\left(\frac{3I_{c7}}{\beta} + I_{c7}\right)\frac{1}{I_s}\right] + \eta V_T \ln\left[\frac{I_{c7}}{I_s}\right]$$

$$V_{be5} + V_{be4} = \eta V_T \ln\left[\left(\frac{3I_{c3}}{\beta} + I_{c7}\right)\frac{1}{I_s}\right] + \eta V_T \ln\left[\frac{I_{c4}}{2I_s}\right]$$

where the fact is exploited that Q4's size and saturation current are twice the size, i.e. M=2, and saturation current of Q5, Q6 and Q7, i.e. M=1.

Resistors $R_{c3}$ and $R_{c4}$ are configured such that the circuit has at the nominal voltage $I_{c4}=2I_{c7}$ then the following relation is independently of β, i.e. independently on the process:

$$V_{be6}+V_{be7}=V_{be5}+V_{be4}=2V_D$$

Since the influence of Q6's base current on current path 20 is substantially equal to the influence of Q5's base current on current path 10, it can also be written:

$$I_{c4} \approx I_{Rc4} = \frac{V_{cc} - V_{be6} - V_{be7}}{R_{c4}} = \frac{V_{cc} - 2V_D}{R_{c4}}$$

$$I_{c3} \approx I_{Rc3} = \frac{V_{cc} - V_{be5} - V_{be4}}{R_{c3}} = \frac{V_{cc} - 2V_D}{R_{c3}}$$

Since in the circuit $R_{c3}=2R_{c4}$, from the formulas shown above follows that $I_{c4}=2I_{c3}$ as previously assumed. On the basis of this, the current flowing in the resistor R is:

$$I_R = \frac{V_{be4} - V_{be3}}{R} = \frac{\eta V_T}{R}\ln\left(\frac{I_{c4}}{I_{s4}}\frac{I_{s3}}{I_{c3}}\right) = \frac{\eta V_T}{R}\ln(2),$$

where $$\frac{I_{s3}}{I_{s4}} = 1$$

because Q3 has the same size as Q4.

A fraction $\chi \approx 1$ of this current is forced in Q2's collector and is also mirrored by Q1. The output current flowing in $R_{load}$ is then:

$$I_{PTAT} = I_{c1} = \chi \frac{\eta V_T}{R}\ln(2).$$

The thermal voltage $V_T$ dominates the temperature dependence of $I_{PTAT}$. Hence, the output current is a PTAT current which is independent on supply voltage and process.

Figure 3:
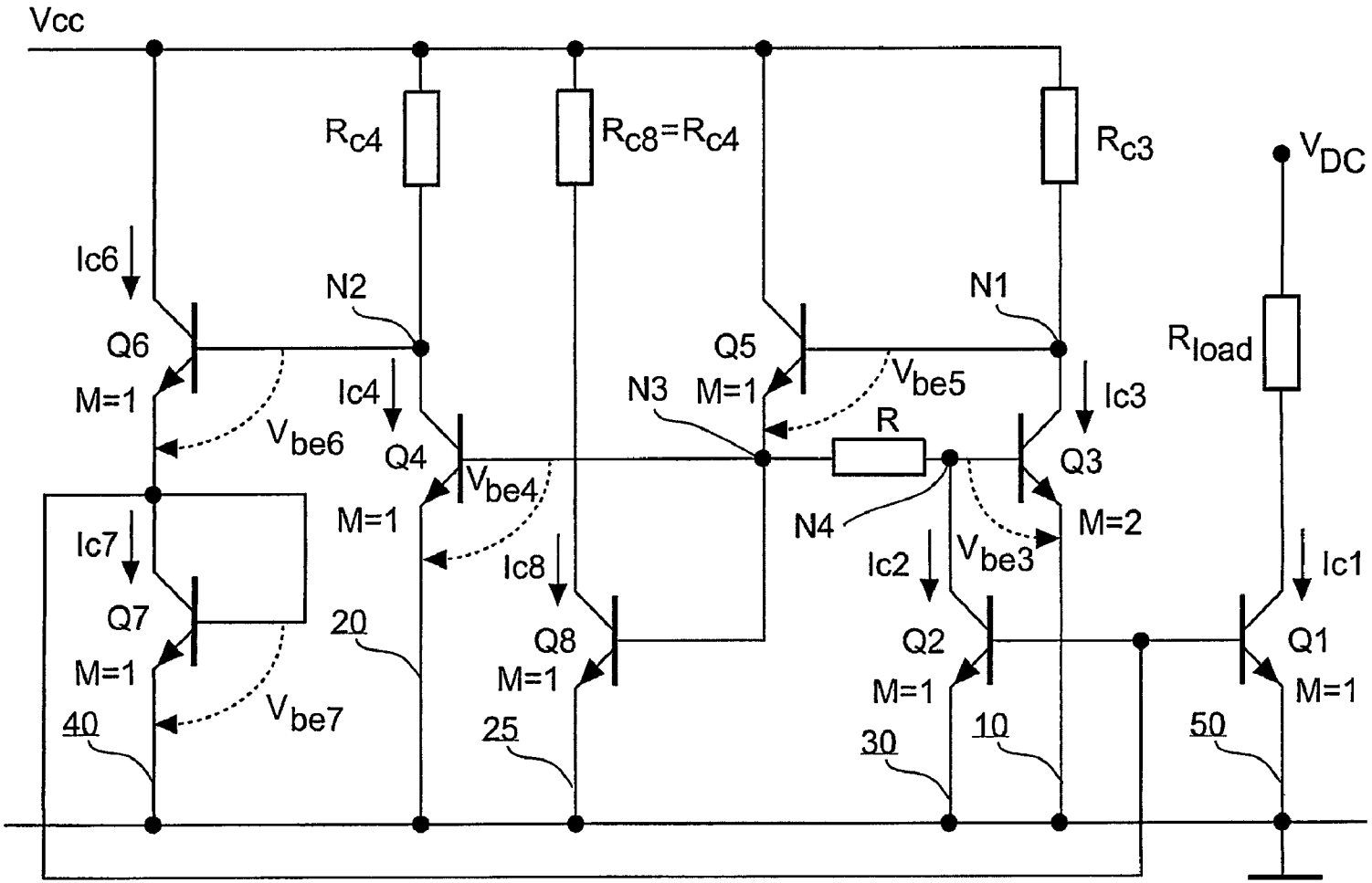
FIG. 3 shows a second embodiment of the PTAT current source of the invention.

FIG. 3 depicts a second embodiment of the PTAT current source of the present invention. For the sake of brevity only the differences between the circuit of FIG. 2 and of FIG. 3 are described in the following. There is a fifth current path 25, also connected between the supply voltage $V_{cc}$ and the reference potential of the circuit. The fifth current path 25 includes a resistor $R_{c8}$ as the third resistive element and a transistor Q8 as the third transistor means. A control terminal of transistor Q8, i.e. the base of Q8, is coupled to the third node N3. As a further difference is to be noted that the areas of transistors Q4 and Q8 are half of the area of transistor Q4 of FIG. 2.

In order to explain how the circuit in FIG. 3 works, it is to be noted that in this embodiment the circuit is configured such that it holds $R_{c3}=R_{c4}$ and transistor Q3 is twice the size of Q4. Assuming that $I_{c4}=I_{c3}$, it follows:

$$I_{c1} = I_{c2} = I_{c7}$$

$$I_{c8} = I_{c4}$$

$$I_{c6} = \frac{3I_{c7}}{\beta} + I_{c7}$$

$$I_{c5} = I_{c7} + \frac{I_{c4}}{\beta} + \frac{I_{c3}}{\beta} + \frac{I_{c8}}{\beta} = I_{c7} + \frac{3I_{c4}}{\beta}$$

and then:

$$V_{be6} + V_{be7} = \eta V_T \ln\left[\left(\frac{3I_{c7}}{\beta} + I_{c7}\right)\frac{1}{I_s}\right] + \eta V_T \ln\left[\frac{I_{c7}}{I_s}\right]$$

$$V_{be5} + V_{be4} = \eta V_T \ln\left[\left(\frac{3I_{c4}}{\beta} + I_{c7}\right)\frac{1}{I_s}\right] + \eta V_T \ln\left[\frac{I_{c4}}{I_s}\right]$$

$R_{c3}$ and $R_{c4}$ are chosen such that the circuit has at the nominal voltage:

$$I_{c4}=I_{c7}$$

then again, independently of β, i.e. independently on the process, it is:

$$V_{be6}+V_{be7}=V_{be5}+V_{be4}=2V_D$$

Once again, since the influences of the base currents on the current paths 10 and 20 are substantially equal, it can also be written:

$$I_{c4} \approx I_{Rc4} = \frac{V_{cc} - V_{be6} - V_{be7}}{R_{c4}} = \frac{V_{cc} - 2V_D}{R_{c4}}$$

$$I_{c3} \approx I_{Rc3} = \frac{V_{cc} - V_{be5} - V_{be4}}{R_{c3}} = \frac{V_{cc} - 2V_D}{R_{c3}}$$

Since the circuit has been configured such that $R_{c3}=R_{c4}$ it becomes clear that $I_{c4}=I_{c3}$. Thus, again the difference $V_{be4}-V_{be3}$ across the resistor R generates the wanted PTAT current:

$$I_R = \frac{V_{be4} - V_{be3}}{R} = \frac{\eta V_T}{R}\ln\left(\frac{I_{c4}}{I_{s4}}\frac{I_{s3}}{I_{c3}}\right) = \frac{\eta V_T}{R}\ln(2),$$

where $$\frac{I_{s3}}{I_{s4}} = 2$$

because Q3 is twice the size of Q4.

Figure 4:
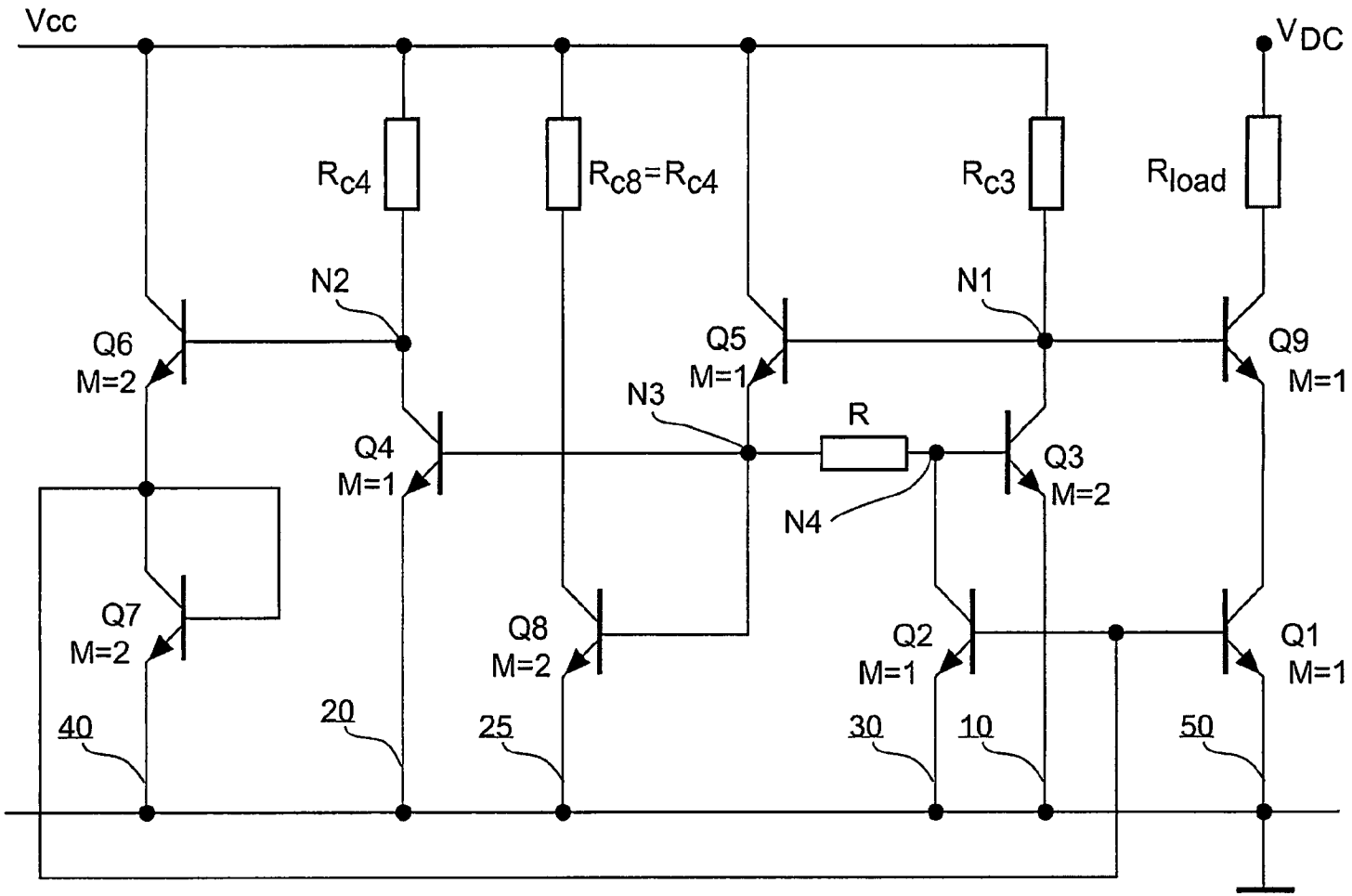
FIG. 4 shows a further development of the second embodiment of the PTAT current source of the invention.

FIG. 4 depicts a further development of the second embodiment of the invention. In order to reduce also the sensitivity versus the supply voltage Vdc of the fourth current path 50 due to the early effect of transistor Q1, the output resistance of the circuit shown in FIG. 3 is increased using the cascade structure of transistors Q1 and Q9, as proposed in FIG. 4. Further, the sizes of transistors Q6, Q7 and Q8 are doubled (M=2) in order to compensate for the extra base current absorbed by transistor Q9. In this way process dependence is again minimized.

Figure 5:
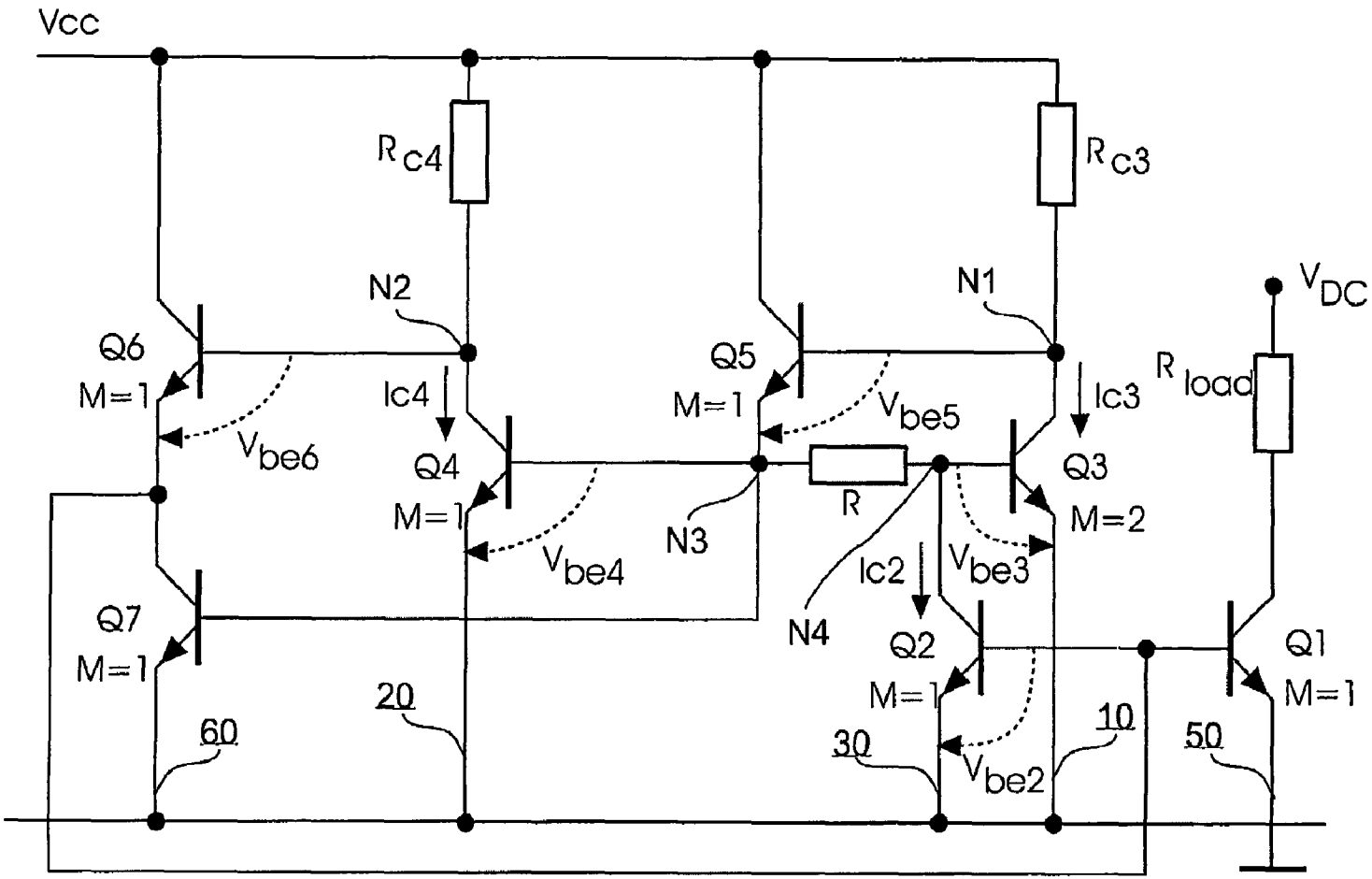
FIG. 5 shows a third embodiment of the PTAT current source of the invention.

FIG. 5 shows a third embodiment of the PTAT current source of the present invention. The structure of the circuit in FIG. 5 is similar to that in FIG. 2. Thus, again for the sake of brevity only the differences between the circuit of FIG. 2 and of FIG. 5 are described in the following. The transistor Q7 is not configured in a diode configuration as in FIG. 2, FIG. 3, and FIG. 5, but in FIG. 5 the base of transistor Q7 is connected to the third node N3 and $R_{c3}=R_{c4}$. Further, the size of transistor Q4 is half the size of transistor Q4 in FIG. 2.

For this configuration of the circuit according the invention, it can easily be found that:

$$V_{be6} + V_{be2} = V_{be}\left[\frac{3I_{c2}}{\beta} + I_{c4}\right] + V_{be}(I_{c2})$$

$$V_{be5} + V_{be4} = V_{be}\left[\frac{2I_{c4}}{\beta} + \frac{I_{c3}}{\beta} + I_{c2}\right] + V_{be}(I_{c4})$$

As for the first and second embodiments, $R_{c3}$ and $R_{c4}$ are configured such that $$I_{c4}=I_{c2}$$

$$V_{be6}+V_{be2}=V_{be5}+V_{be4}=2V_D$$

independently on the absolute value of β, i.e. independently on the process.

This forces equal currents in Q3 and Q4's collectors and the difference $V_{be4}-V_{be3}$ across the resistor R generates the wanted PTAT current.

Figure 6:
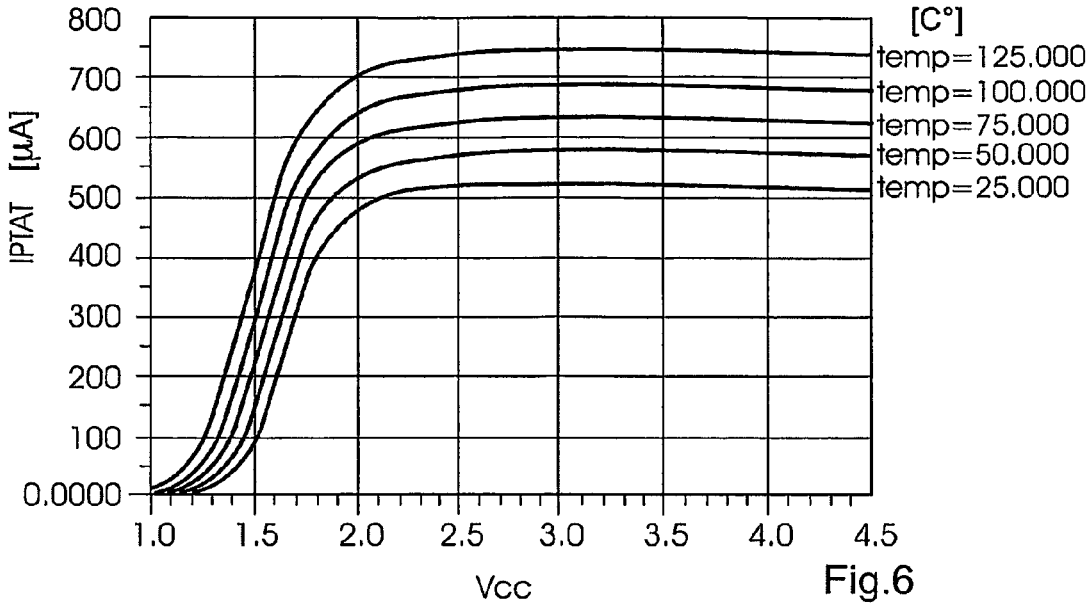
FIG. 6 shows the output current versus supply voltage using temperature as a parameter of the first embodiment.
Figure 7:
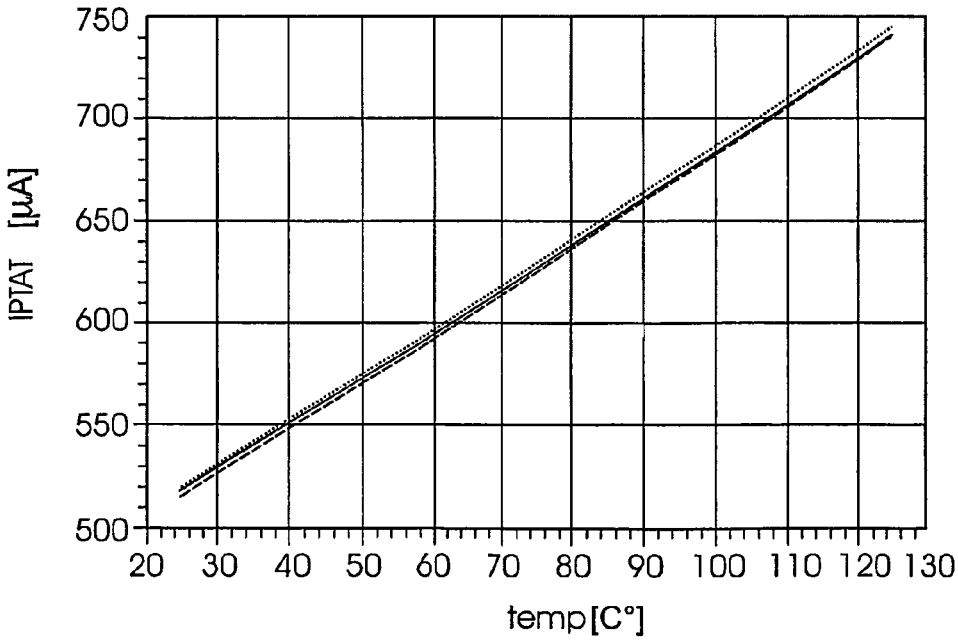
FIG. 7 shows the PTAT current variation versus temperature for three different supply voltages of the first embodiment.

For illustration of the effectiveness of the present invention, embodiments of the present invention presented above have been implemented using an Indium Phosphide single heterojunction transistors (InP SHBT) process featuring a typical β of 30 at T=25° C. The model used is VBIC (Vertical Bipolar Inter-Company) and the transistors have an emitter size of 1 μm×5 μm. For the implementation have been chosen $R_{c3}=2R_{c4}=3k\Omega$ and R=45Ω. Simulation results for the schematic of the first embodiment are presented in FIG. 6 which shows the output current versus supply voltage using temperature as a parameter. The maximum average variation of $I_{PTAT}$ versus supply voltage in the range $V_{cc}$=2.5 . . . 4.5V is 0.98% at 25° C. and 0.24% at 125° C. Further, FIG. 7 shows the PTAT current variation versus temperature for three different supply voltages, $V_{cc}$=2.5V (solid line), $V_{cc}$=3.5V (dotted line), $V_{cc}$=4.5V (dashed line).

By the present invention an improved PTAT current source and a respective method for generating a PTAT current has been disclosed. In general, opportune collector currents are generated and forced in two transistors exploiting the logarithmic relation between the base-emitter voltage and the collector current of a transistor. A resistor senses a voltage difference between the base-emitter voltages of the two transistors which can have either same or different areas. A fraction of the current flowing through the resistor is forced into a transistor collector and mirrored by an output transistor for providing an output current. By this principle an all npn-transistor PTAT current source can be provided that does not need pnp transistors as in conventional PTAT current sources. The present invention is generally applicable to a variety of different types of integrated circuits needing a PTAT current reference, especially in modern advanced technologies as InP and GaAs where p-type devices are not available. For example, the PTAT current source circuit of the invention can be used in radio frequency power amplifiers, in radio frequency tag circuits, in a satellite microwave front-end.

Finally but yet importantly, it is noted that the term "comprising" when used in the specification including the claims is intended to specify the presence of stated features, means, steps or components, but does not exclude the presence or addition of one or more other features, means, steps, components or groups thereof. Further, the word "a" or "an" preceding an element in a claim does not exclude the presence of a plurality of such elements. Moreover, any reference sign does not limit the scope of the claims. Furthermore, it is to be noted that "coupled" is to be understood that there is a current path between those elements that are coupled; i.e. "coupled" does not mean that those elements are directly connected.

The invention claimed is:

1. A circuit for generating a current proportional to absolute temperature, the circuit comprising:

a first current path including a first resistive element and first transistor coupled at a first node and a second current path in parallel with the first current path including a second resistive element and a second transistor coupled at a second node;

a PTAT current path in parallel with the first and second current paths including a first current source configured to be controlled by a signal from the first node, a second current source configured to be controlled by a signal from the second node, and a current sensing element inter-coupled between the first current source and the second current source at a third node and fourth node, respectively;

a control terminal of the first transistor coupled to the fourth node and a control terminal of the second transistor coupled to the third node; and a third current path including a third current source configured to be controlled by the signal of the second node and to emboss a reference current into a current mirror.

2. The circuit according to claim 1, wherein the second current source is a mirror current source of the current mirror.

3. A circuit for generating a current proportional to absolute temperature, the circuit comprising:

a first current path including a first resistive element and first transistor coupled at a first node and a second current path in parallel with the first current path including a second resistive element and a second transistor coupled at a second node;

a PTAT current path in parallel with the first and second current paths including a first current source configured to be controlled by a signal from the first node, a second current source configured to be controlled by a signal from the second node, and a current sensing element inter-coupled between the first current source and the second current source at a third node and fourth node, respectively;

a control terminal of the first transistor coupled to the fourth node and a control terminal of the second transistor coupled to the third node; and a fourth current path including a fourth current source configured such that a current of the fourth current source is proportional to a current of the second current source.

4. The circuit according to claim 3, wherein the fourth current path further comprises a fifth current source configured to be controlled by the signal from the first node.

5. A circuit for generating a current proportional to absolute temperature, the circuit comprising:

a first current path including a first resistive element and first transistor coupled at a first node and a second current path in parallel with the first current path including a second resistive element and a second transistor coupled at a second node;

a PTAT current path in parallel with the first and second current paths including a first current source configured to be controlled by a signal from the first node, a second current source configured to be controlled by a signal from the second node, and a current sensing element inter-coupled between the first current source and the second current source at a third node and fourth node, respectively;

a control terminal of the first transistor coupled to the fourth node and a control terminal of the second transistor coupled to the third node; and a fifth current path including a third resistive element and third transistor, wherein a control terminal of the third transistor is coupled to the third node.

6. A circuit for generating a current proportional to absolute temperature, the circuit comprising:

a first current path including a first resistive element and first transistor coupled at a first node and a second current path in parallel with the first current path including a second resistive element and a second transistor coupled at a second node;

a PTAT current path in parallel with the first and second current paths including a first current source configured to be controlled by a signal from the first node, a second current source configured to be controlled by a signal from the second node, and a current sensing element inter-coupled between the first current source and the second current source at a third node and fourth node, respectively;

a control terminal of the first transistor coupled to the fourth node and a control terminal of the second transistor coupled to the third node; and a sixth current path including a sixth current source and seventh current source coupled at a fifth node, the sixth current source is configured to be controlled by a signal of the second node and the seventh current source is configured to be controlled by a signal of the third node, wherein the second current source is configured to be controlled by a signal from the fifth node.

7. A circuit for generating a current proportional to absolute temperature, the circuit comprising:

a first current path including a first resistive element and first transistor coupled at a first node and a second current path in parallel with the first current path including a second resistive element and a second transistor coupled at a second node;

a PTAT current path in parallel with the first and second current paths including a first current source configured to be controlled by a signal from the first node, a second current source configured to be controlled by a signal from the second node, and a current sensing element inter-coupled between the first current source and the second current source at a third node and fourth node, respectively; and a control terminal of the first transistor coupled to the fourth node and a control terminal of the second transistor coupled to the third node; and wherein the respective current sources are implanted by respective transistors.

8. The circuit according to claim 7, wherein the transistors of the circuit either are all npn-transistors or are all pnp transistors.

9. A radio frequency power amplifier, a circuit in radio frequency tag, or a circuit in a satellite microwave front-end comprising a current sourcing circuit for generating a current proportional to absolute temperature, the circuit comprising:

a first current path including a first resistive element and first transistor coupled at a first node and a second current path in parallel with the first current path including a second resistive element and a second transistor coupled at a second node;

a PTAT current path in parallel with the first and second current paths including a first current source configured to be controlled by a signal from v first node, a second current source configured to be controlled by a signal from the second node, and a current sensing element inter-coupled between the first current source and the second current source at a third node and fourth node, respectively; and a control terminal of the first transistor coupled to the fourth node and a control terminal of the second transistor coupled to the third node.

10. A method for generating a current proportional to absolute temperature, the method comprising:

pulling up potentials of first and second nodes with respective first and second resistive elements;

supplying a control signal from the first node to a first current source;

supplying a control signal from the second node to a second current source;

initiating a flow of current between the first current source and a third node;

initiating a flow of current between the second current source and a fourth node;

initiating a flow of current in a PTAT current path with the first and second current sources;

conducting first and second transistors as a result of the flows of current either to or from the first and second current sources;

allowing currents to flow in first and second current paths through the respective first and second transistors as a result of conducting the first and second transistors;

sensing current between the first current source and the second current source; and supplying a control signal from the second node to a third current source in a third current path to emboss a reference current into a current mirror.

11. The method of claim 10, wherein the second current source is a mirror current source of the current mirror.

12. A method for generating a current proportional to absolute temperature, the method comprising:

pulling up potentials of first and second nodes with respective first and second resistive elements;

supplying a control signal from the first node to a first current source;

supplying a control signal from the second node to a second current source;

initiating a flow of current between the first current source and a third node;

initiating a flow of current between the second current source and a fourth node;

initiating a flow of current in a PTAT current path with the first and second current sources;

conducting first and second transistors as a result of the flows of current either to or from the first and second current sources;

allowing currents to flow in first and second current paths through the respective first and second transistors as a result of conducting the first and second transistors;

sensing current between the first current source and the second current source; and supplying a control signal to a fourth current source in a fourth current path, a current of the fourth current source proportional to a current of the second current source.

13. The method of claim 12, further comprising:

supplying a control signal from the first node to a fifth current source in the fourth current path.

14. A method for generating a current proportional to absolute temperature, the method comprising:

pulling up potentials of first and second nodes with respective first and second resistive elements;

supplying a control signal from the first node to a first current source;

supplying a control signal from the second node to a second current source;

initiating a flow of current between the first current source and a third node;

initiating a flow of current between the second current source and a fourth node;

initiating a flow of current in a PTAT current path with the first and second current sources;

conducting first and second transistors as a result of the flows of current either to or from the first and second current sources;

allowing currents to flow in first and second current paths through the respective first and second transistors as a result of conducting the first and second transistors;

sensing current between the first current source and the second current source; and supplying a control signal from the third node to a third transistor, the third transistor in a fifth current path with a third resistive element.

15. A method for generating a current proportional to absolute temperature, the method comprising:

pulling up potentials of first and second nodes with respective first and second resistive elements;

supplying a control signal from the first node to a first current source;

supplying a control signal from the second node to a second current source;

initiating a flow of current between the first current source and a third node;

initiating a flow of current between the second current source and a fourth node;

initiating a flow of current in a PTAT current path with the first and second current sources;

conducting first and second transistors as a result of the flows of current either to or from the first and second current sources;

allowing currents to flow in first and second current paths through the respective first and second transistors as a result of conducting the first and second transistors;

sensing current between the first current source and the second current source; and supplying a control signal from the second node to a sixth current source;

supplying a control signal from the third node to a seventh current source, the sixth and seventh current sources coupled at a fifth node; and supplying a control signal from the fifth node to the second current source.

16. A method for generating a current proportional to absolute temperature, the method comprising:

pulling up potentials of first and second nodes with respective first and second resistive elements;

supplying a control signal from the first node to a first current source;

supplying a control signal from the second node to a second current source;

initiating a flow of current between the first current source and a third node;

initiating a flow of current between the second current source and a fourth node;

initiating a flow of current in a PTAT current path with the first and second current sources;

conducting first and second transistors as a result of the flows of current either to or from the first and second current sources;

allowing currents to flow in first and second current paths through the respective first and second transistors as a result of conducting the first and second transistors;

sensing current between the first current source and the second current source;

wherein the current sources are implemented by transistors; and wherein the transistors either are all npn-transistors or are all pnp transistors.

17. A method for generating a current proportional to absolute temperature, the method comprising:

pulling up potentials of first and second nodes with respective first and second resistive elements;

supplying a control signal from the first node to a first current source;

supplying a control signal from the second node to a second current source;

initiating a flow of current between the first current source and a third node;

initiating a flow of current between the second current source and a fourth node;

initiating a flow of current in a PTAT current path with the first and second current sources;

conducting first and second transistors as a result of the flows of current either to or from the first and second current sources;

allowing currents to flow in first and second current paths through the respective first and second transistors as a result of conducting the first and second transistors;

sensing current between the first current source and the second current source;

wherein the current sources are implemented by transistors; and wherein the current proportional to absolute temperature is implemented in a radio frequency power amplifier, a circuit in radio frequency tag, or a circuit in a satellite microwave front-end.

* * * * *